US011089660B2

(12) United States Patent
Wensley et al.

(10) Patent No.: US 11,089,660 B2
(45) Date of Patent: Aug. 10, 2021

(54) ELECTRONIC VAPORIZATION DEVICES

(71) Applicant: Fontem Holdings 1 B.V., Amsterdam (NL)

(72) Inventors: Martin Wensley, Los Gatos, CA (US); Michael Hufford, Chapel Hill, NC (US); Peter Lloyd, Walnut Creek, CA (US)

(73) Assignee: FONTEM HOLDINGS 1 B.V., Amsterdam (NL)

( * ) Notice: Subject to any disclaimer, the term of this patent is extended or adjusted under 35 U.S.C. 154(b) by 402 days.

(21) Appl. No.: 15/004,431

(22) Filed: Jan. 22, 2016

(65) Prior Publication Data

US 2016/0213065 A1 Jul. 28, 2016

Related U.S. Application Data

(60) Provisional application No. 62/106,679, filed on Jan. 22, 2015, provisional application No. 62/153,463,
(Continued)

(51) Int. Cl.
*H05B 3/46* (2006.01)
*H05B 1/02* (2006.01)
(Continued)

(52) U.S. Cl.
CPC ..... *H05B 3/46* (2013.01); *A24F 40/46* (2020.01); *A24F 40/48* (2020.01); *A24F 40/485* (2020.01);
(Continued)

(58) Field of Classification Search
CPC ..... B44C 7/027; D06F 75/30; D06F 87/00
(Continued)

(56) References Cited

U.S. PATENT DOCUMENTS 2,057,353 A 10/1936 Whittemore
2,415,748 A 2/1947 Lowell
(Continued)

FOREIGN PATENT DOCUMENTS

CN 1323231 A 11/2001
CN 1541577 A 11/2004
(Continued)

OTHER PUBLICATIONS

Europeant Paten Office, extended European Search Report for European Application No. 15840089.5; dated Feb. 13, 2018; 6 pages.
(Continued)

*Primary Examiner* — Tu B Hoang
*Assistant Examiner* — Thomas J Ward
(74) *Attorney, Agent, or Firm* — Perkins Coie LLP; Kenneth H. Ohriner

(57) ABSTRACT

A device for generating a condensation aerosol includes vaporization chamber having an upstream first inlet and a downstream outlet. A tube supplies liquid to a heater in the vaporization chamber. The liquid is pumped out of the tube and onto the heater, which vaporizes the liquid. Air flows from inlets through the vaporization chamber, and generally perpendicular to the tube. The vaporized liquid is entrained in the air, forming a condensation aerosol having a particle size in a selected range. A second inlet provides a substantially laminar flow of air into the airflow path, wherein the second inlet is downstream of the heater; and the device capable of changing air flow in the vaporization chamber to change the particle size of the condensation aerosol and/or to change the amount of visible vapor emitted from the device.

16 Claims, 11 Drawing Sheets

Related U.S. Application Data filed on Apr. 27, 2015, provisional application No. 62/192,377, filed on Jul. 14, 2015.

(51) Int. Cl.

| | |
|---|---|
| ***H05B 3/16*** | (2006.01) |
| ***A24F 40/46*** | (2020.01) |
| ***A24F 40/48*** | (2020.01) |
| ***A24F 40/485*** | (2020.01) |
| ***A24F 40/50*** | (2020.01) |
| ***A24F 40/10*** | (2020.01) |

(52) U.S. Cl.

CPC ..... *A24F 40/50* (2020.01); *H05B 1/0244* (2013.01); *H05B 3/16* (2013.01); *A24F 40/10* (2020.01)

(58) Field of Classification Search

USPC ..... 128/200.14, 203.17, 203.36; 392/390, 392/391, 399, 404; 219/483, 497; 700/266

See application file for complete search history.

(56) References Cited

U.S. PATENT DOCUMENTS

| | | | | |
|---|---|---|---|---|
| 3,200,819 | A | 8/1965 | Gilbert | |
| 3,479,561 | A | 11/1969 | Janning | |
| 4,207,457 | A | 6/1980 | Haglund et al. | |
| 4,446,862 | A | 5/1984 | Baum et al. | |
| 4,735,217 | A * | 4/1988 | Gerth | A24F 47/008 128/203.17 |
| 4,953,572 | A | 9/1990 | Rose et al. | |
| 5,388,574 | A | 2/1995 | Ingebrethsen et al. | |
| 5,487,378 | A | 1/1996 | Robertson et al. | |
| 5,666,977 | A * | 9/1997 | Higgins | A24F 47/008 128/200.14 |
| 5,743,251 | A | 4/1998 | Howell et al. | |
| 5,894,841 | A | 4/1999 | Voges | |
| 6,116,237 | A | 9/2000 | Schultz et al. | |
| 6,155,268 | A * | 12/2000 | Takeuchi | A24F 47/008 131/273 |
| 6,234,167 | B1 * | 5/2001 | Cox | A61M 15/0003 128/200.14 |
| 6,443,146 | B1 | 9/2002 | Voges | |
| 6,516,796 | B1 | 2/2003 | Cox et al. | |
| 6,557,552 | B1 | 5/2003 | Beane et al. | |
| 6,598,602 | B1 | 7/2003 | Sjoholm | |
| 6,804,458 | B2 * | 10/2004 | Sherwood | A61M 11/041 122/242 |
| 6,923,179 | B2 * | 8/2005 | Gupta | A61M 11/041 128/200.14 |
| 7,128,067 | B2 * | 10/2006 | Byron | A61M 11/041 128/200.14 |
| 7,159,507 | B2 | 1/2007 | Grollimund et al. | |
| 7,167,776 | B2 * | 1/2007 | Maharajh | F22B 1/28 700/266 |
| 7,743,766 | B2 | 6/2010 | Gupta et al. | |
| 7,913,688 | B2 | 3/2011 | Cross et al. | |
| 8,156,944 | B2 | 4/2012 | Han | |
| 8,191,555 | B2 | 6/2012 | Herbrich et al. | |
| 8,365,742 | B2 | 2/2013 | Hon | |
| 8,375,957 | B2 | 2/2013 | Hon | |
| 8,511,318 | B2 | 8/2013 | Hon | |
| 8,794,231 | B2 | 8/2014 | Thorens et al. | |
| 8,857,446 | B2 | 10/2014 | Wu | |
| 8,903,228 | B2 | 12/2014 | O'Neill et al. | |
| 8,910,640 | B2 | 12/2014 | Sears et al. | |
| 8,948,578 | B2 | 2/2015 | Buchberger | |
| 9,072,321 | B2 | 7/2015 | Liu | |
| 9,414,629 | B2 | 8/2016 | Egoyants et al. | |
| 9,420,829 | B2 * | 8/2016 | Thorens | A24F 47/008 |
| 9,427,711 | B2 | 8/2016 | Terry et al. | |
| 9,510,623 | B2 | 12/2016 | Tucker et al. | |
| 9,609,893 | B2 | 4/2017 | Novak et al. | |
| 9,609,894 | B2 | 4/2017 | Abramov et al. | |
| 9,648,905 | B2 | 5/2017 | Levitz et al. | |
| 9,668,523 | B2 | 6/2017 | Tucker et al. | |
| 9,687,027 | B2 | 6/2017 | Poston et al. | |
| 9,713,346 | B2 | 7/2017 | Hon | |
| 10,721,963 | B2 | 7/2020 | Thorens et al. | |
| 2003/0108342 | A1 | 6/2003 | Sherwood et al. | |
| 2004/0025865 | A1 | 2/2004 | Nichols et al. | |
| 2004/0079368 | A1 | 4/2004 | Gupta et al. | |
| 2004/0129793 | A1 | 7/2004 | Nguyen et al. | |
| 2005/0235991 | A1 | 10/2005 | Nichols et al. | |
| 2005/0268911 | A1 | 12/2005 | Cross et al. | |
| 2006/0047368 | A1 | 3/2006 | Maharajh et al. | |
| 2006/0249144 | A1 | 11/2006 | DeHaan et al. | |
| 2008/0264416 | A1 | 10/2008 | Gonda et al. | |
| 2009/0095311 | A1 | 4/2009 | Han | |
| 2009/0126745 | A1 | 5/2009 | Hon | |
| 2009/0188490 | A1 | 7/2009 | Han | |
| 2009/0196930 | A1 | 8/2009 | Surber et al. | |
| 2009/0235926 | A1 | 9/2009 | Cross | |
| 2011/0005535 | A1 | 1/2011 | Xiu | |
| 2011/0094523 | A1 | 4/2011 | Thorens et al. | |
| 2011/0120456 | A1 | 5/2011 | Immel | |
| 2011/0209717 | A1 | 9/2011 | Han | |
| 2011/0233043 | A1 | 9/2011 | Cross et al. | |
| 2011/0277757 | A1 | 11/2011 | Terry et al. | |
| 2012/0006342 | A1 | 1/2012 | Rose et al. | |
| 2012/0111347 | A1 | 5/2012 | Hon | |
| 2012/0186594 | A1 | 7/2012 | Liu | |
| 2013/0008540 | A1 | 1/2013 | Shah et al. | |
| 2013/0032139 | A1 | 2/2013 | Hale et al. | |
| 2013/0180525 | A1 | 7/2013 | Cross et al. | |
| 2013/0199528 | A1 | 8/2013 | Goodman et al. | |
| 2013/0213418 | A1 | 8/2013 | Tucker et al. | |
| 2013/0220316 | A1 | 8/2013 | Oglesby et al. | |
| 2013/0284192 | A1 | 10/2013 | Peleg et al. | |
| 2014/0144429 | A1 | 5/2014 | Wensley et al. | |
| 2014/0190496 | A1 | 7/2014 | Wensley et al. | |
| 2014/0207016 | A1 | 7/2014 | Addington et al. | |
| 2014/0261408 | A1 | 9/2014 | Wobler et al. | |
| 2014/0261492 | A1 | 9/2014 | Kane et al. | |
| 2014/0270729 | A1 | 9/2014 | Novak et al. | |
| 2014/0270730 | A1 | 9/2014 | Depiano et al. | |
| 2014/0283855 | A1 * | 9/2014 | Hawes | A24F 47/008 131/328 |
| 2014/0334802 | A1 | 11/2014 | Dubief | |
| 2014/0350028 | A1 | 11/2014 | Weers et al. | |
| 2014/0353856 | A1 | 12/2014 | Dubief | |
| 2015/0181937 | A1 | 6/2015 | Dubief et al. | |
| 2015/0196060 | A1 * | 7/2015 | Wensley | F22B 1/288 392/390 |
| 2015/0351456 | A1 | 12/2015 | Johnson et al. | |
| 2016/0324212 | A1 | 11/2016 | Cameron | |

FOREIGN PATENT DOCUMENTS

| | | | |
|---|---|---|---|
| CN | 202014571 | U | 10/2011 |
| CN | 102655773 | | 9/2012 |
| CN | 103917119 | A | 7/2014 |
| CN | 103974635 | A | 8/2014 |
| CN | 203748678 | U | 8/2014 |
| DE | 202010002041 | U1 | 5/2010 |
| EP | 0845220 | A1 | 6/1998 |
| EP | 845220 | A1 | 6/1998 |
| EP | 1618803 | A1 | 1/2006 |
| EP | 2047880 | A1 | 4/2009 |
| EP | 2113178 | A1 | 11/2009 |
| EP | 2764783 | A1 | 8/2014 |
| JP | 2002527153 | A | 8/2002 |
| KZ | 28108 | B | 2/2013 |
| RU | 2297781 | C2 | 4/2007 |
| WO | 0021598 | A1 | 4/2000 |
| WO | 03034847 | A1 | 5/2003 |
| WO | 2004050139 | A2 | 6/2004 |
| WO | 2004060903 | A2 | 7/2004 |
| WO | 2005025654 | A1 | 3/2005 |
| WO | 2009132793 | A1 | 11/2009 |
| WO | 2011160788 | A1 | 12/2011 |

(56) References Cited

FOREIGN PATENT DOCUMENTS

| | | | |
|---|---|---|---|
| WO | 2012026963 | A2 | 3/2012 |
| WO | 2013083635 | A1 | 6/2013 |
| WO | 2013083636 | A1 | 6/2013 |
| WO | 2014110119 | A1 | 7/2014 |
| WO | 2014150573 | A2 | 9/2014 |
| WO | 2014159982 | A1 | 10/2014 |
| WO | 2015100361 | A1 | 7/2015 |

OTHER PUBLICATIONS

Extended European Search Report for European Patent Application No. 15740106.8; dated Sep. 26, 2017; 9 pages.
Australian Government IP Australia, Examination Report No. 1 for Australian Patent Application No. 2016209328; dated Aug. 28, 2018; 4 pages.
Rosepatent, Examination Report for Russian Federation Patent Application No. 2017128298; dated Aug. 6, 2018; 8 pages.
State Intellectual Property Office, Office Action in Chinese Application No. 201580014558.8; dated Sep. 27, 2018; 12 pages.
Canadian Patent Office, Office Action in Canadian Application No. 2,974,364; dated Sep. 18, 2018; 6 pages.
European Patent Office, extended European Search Report for European Application No. 16740689.1; dated Dec. 18, 2018; 12 pages.
Korea Intellectual Property Rights Information Service, Office Action for Korean Application No. 10-2017-7023325; dated Mar. 28, 2019; 4 pages.
Partial English Machine Translation of Korea Intellectual Property Rights Information Service, Office Action for Korean Application No. 10-2017-7023325; dated Mar. 28, 2019; 1 page.
State Intellectual Property Office, Office Action for Chinese Application No. 201580014558.8; dated Jun. 5, 2019; 23 pages.
State Intellectual Property Office, Office Action in Chinese Application No. 2015800534285; dated Dec. 3, 2019; English translation only; 8 pages.
State Intellectual Property Office, Office Action in Chinese Application No. 201580053428.5; dated Dec. 3, 2019; 10 pages.
State Intellectual Property Office First Office Action for Chinese Application No. 201680017277.2; dated Dec. 19, 2019; with English translation; 22 pages.
USPTO, International Search Report and Written Opinion for PCT/US2016/014158, dated May 3, 2016 18 pages.
S. Korea, Notice of Final Rejection for Application No. 10-2017-7023325 dated Sep. 20, 2019, 7 pages.
S. Korea, Notice of Final Rejection for Application No. 10-2017-7023325 dated Nov. 22, 2019, 2 pages.
The State Intellectual Property Office of People's Republic of China, the Second Office Action for Application No. 201680017277.2 dated Jun. 2020, 11 pages.
Austrailian Examination Report No. 1 for Application No. 2016209328 dated Aug. 28, 2018, 4 pges.
Notice of Reasons for Refusal for Japanese Patent Application No. 2017-557277 dated Jul. 12, 2018.
International Preliminary Report on Patentability and Written Opinion of the International Search Authority for International Application No. PCT/US2016/014158, dated Jul. 25, 2017, 14 pages.
Full translation of Mar. 28,2019 S. Korea office action from Global Dossier for Application No. 10-2017-7023325, 3 pages.

* cited by examiner

ELECTRONIC VAPORIZATION DEVICES

CROSS-REFERENCE TO RELATED APPLICATION(S)

This application claims priority to U.S. Provisional Patent Application Nos. 62/106,679, filed Jan. 22, 2015; 62/153,463, filed Apr. 27, 2015; and 62/192,377 filed Jul. 9, 2015 and incorporated herein by reference.

BACKGROUND OF THE INVENTION

Multiple factors can contribute to tobacco cigarette addiction. Some of the factors include addiction to nicotine or psychological factors including the smell, taste, or social associations of tobacco cigarette smoking. One factor that can drive cigarette addiction is the sensory cues associated with the inhalation and exhalation of smoke itself. Some electronic cigarettes create a large amount of vapor to simulate tobacco cigarette smoke. To avoid vapor deposition in the lung and to preclude exhalation of the vapor, some known devices provide aerosol particles between 0.2 microns and 0.6 microns. Aerosol particles in this size range can be too small to gravitationally settle in the lung during regular breathing. Consequently, they tend to be inhaled and then are subsequently exhaled.

Smokers can exhibit a wide range of inhalation profiles. Variation exist among smokers in inhalation rates and the total volume inhaled. Inhalation rates can also vary in different ways from the peak inhalation rate that the smoker achieves to the actual profile (e.g. an inhalation rate that starts slow compared to one that starts rapidly. The efficiency of deep lung deposition can be dependent on many factors such as aerosol particle size, the timing of the delivery of the aerosol to the lung (where in the inhalation volume—early vs. late) and inhalation rates. Inhalation profiles can also affect where aerosols are deposited in the respiratory tract. A more rapid inhalation rate can cause larger aerosol particles to deposit in the back of the throat, mouth and upper airway due to inertial impaction. Shallow breathers, with lower total inhalation volumes, can benefit from aerosol delivered earlier in the inhalation volume, allowing the aerosol to be chased into the deep lung without leaving aerosol in the mouth, throat and upper airway.

These factors create engineering challenges in designing an electronic cigarette or other vaporization device that replicates the tobacco cigarette smoking experience. There is a need for new methods and devices for administering compounds, such as nicotine, to a user. In particular, there is a need for methods and devices for delivery of compounds to a user where the compounds are aerosolized to fall within a specified particle size range. For example, there is a need for improved methods and devices to deliver nicotine to a user in specified doses and in a specified particle range size without the carcinogens and other chemicals associated with tobacco products.

SUMMARY OF THE INVENTION

A device for generating a vapor or condensation aerosol has a heater, such as a wire coil, around a tube in a vaporization chamber between an upstream inlet and a downstream outlet. A reservoir in the device holds a liquid. A pump supplies liquid from a reservoir into the tube. The liquid, which may include nicotine, flows onto the heater via outlets in the tube. The vaporization chamber is part of an airflow passageway which may be configured to produce a condensation aerosol having a particle diameter from about 1 μm to about 5 microns.

The pump may optionally be completely or partially within the reservoir, or the pump may have a drive motor located outside of the reservoir. The drive motor may operate with a solenoid coil magnetically coupled to one or more magnets within the pump.

The airflow path through the vaporization chamber may have a second inlet configured to permit a substantially laminar flow of air into the airflow path, wherein the second inlet is downstream of the heater. The air flow path and/or openings into the air flow path may be changed to change the particle size of a condensation aerosol produced in the vaporization chamber, and/or to change the amount of visible vapor emitted from the device.

The device may have an inlet adjuster to control the size of the upstream first inlet. The inlet adjuster may be a slide configured to slidably cover the upstream first inlet, or a removable orifice configured to modify the upstream first inlet. The removable orifice, if used, is optionally configured to insert into the upstream first inlet. An opening of the removable orifice may have a cross-sectional area that is less than a cross-sectional area of the upstream first inlet.

The inlet adjuster may be electronically-controlled. A user interface may be provided in electronic communication with the inlet adjuster, with the user interface configured to allow a user to select a condensation aerosol particle size to be produced by the device. Multiple upstream first inlets may be used with the inlet adjuster to change the number of inlets used. The outlet may be in a mouthpiece connecting with the vaporization chamber, and a plurality of inlets upstream of the heater. A baffle may be located upstream of the heater, with the baffle configured to slide within the vaporization chamber, optionally based on a user input.

The device may include a flow sensor electrically connected to an electronic controller which receives and stores an inhalation profile of a user of the device, with the device configured to modify a characteristic of the device based on the inhalation profile. The device may further include a user interface configured to permit a user to modify a characteristic of the device, which may provide more efficient delivery of the condensation aerosol to a deep lung of a user; cause a user of the device to exhale a lower fraction of the condensation aerosol; and/or adjust a sensory effect, such as mouth feel or appearance of the aerosol.

Alternatively, the modified characteristic may be an amount of liquid vaporized by the heater; an amount of current applied to the heater; or a size of the inlet. The flow sensor may be a hot wire or vane type flow meter or a pressure transducer configured to measure an inhalation vacuum. The pressure transducer, if used, may be configured to calculate an inhalation rate. The electronic controller may include a microprocessor and/or a wireless communication device. The device can be configured to calculate optimum parameters for condensation aerosol generation based on an inhalation profile of a user. In this case, the modified characteristics can include the aerosol particle size; the timing of aerosol generation in a user inhalation volume; a resistance to air flow through the device, or an inhalation rate of a user of the device.

The inhalation profile may include inhalation rates of a user over a period of time; a total volume of air inhaled; or a peak inhalation rate of a user of the device. The device may be programmed to automatically modify a characteristic of the device based on the inhalation profile, or to allow manual modification of a characteristic of the device by a user based on the inhalation profile.

DETAILED DESCRIPTION

Figure 1:
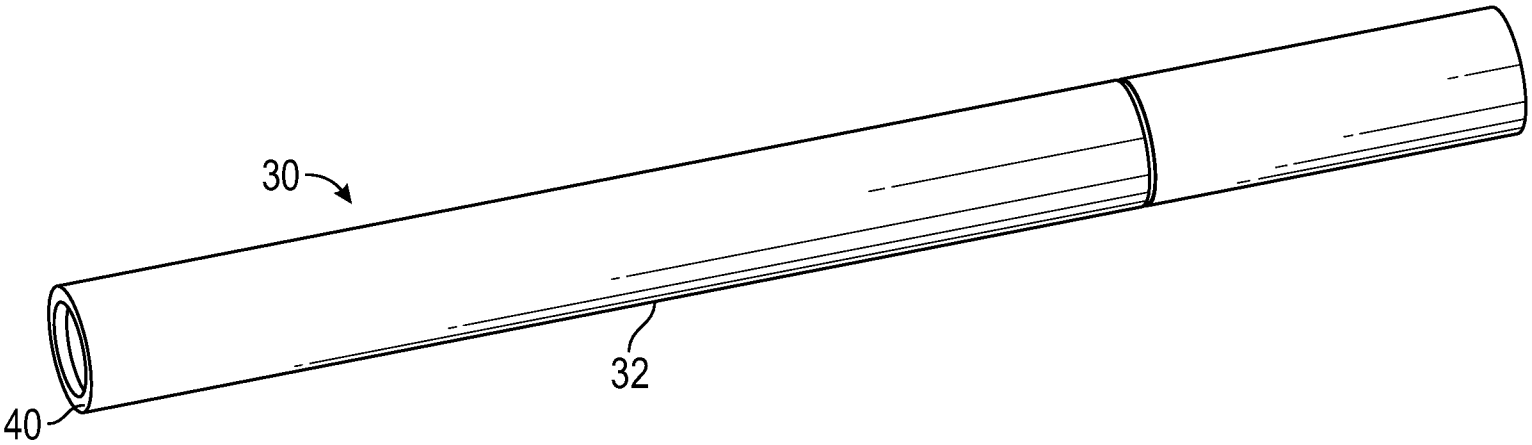
FIG. 1 is a side perspective view of a cylindrical aerosol generating device.
Figure 2:
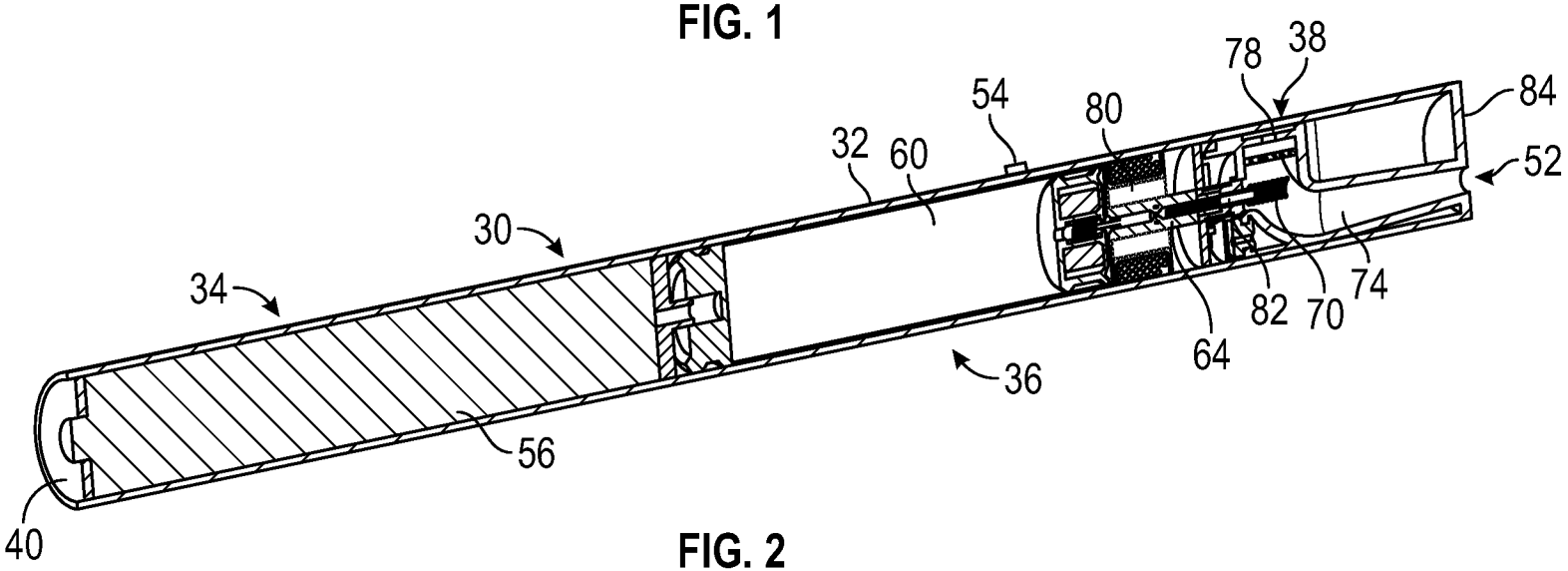
FIG. 2 is a perspective section view of the device of FIG. 1.
Figure 3:
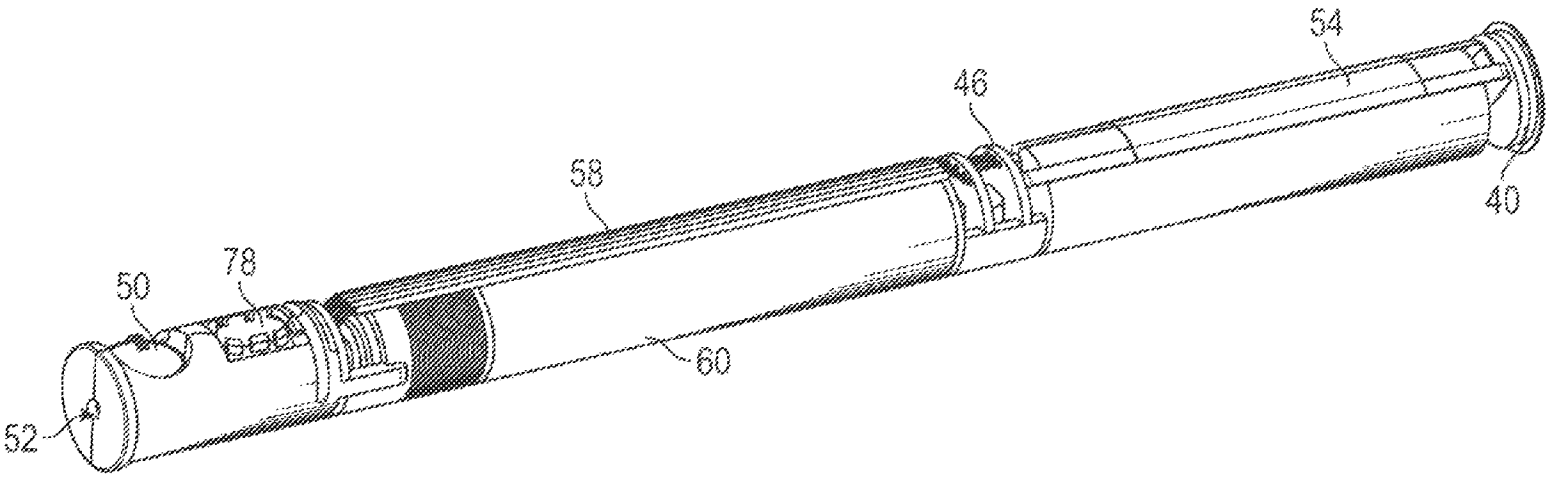
FIG. 3 is a perspective view of the components of the device of FIG. 1 without the housing.
Figure 4:
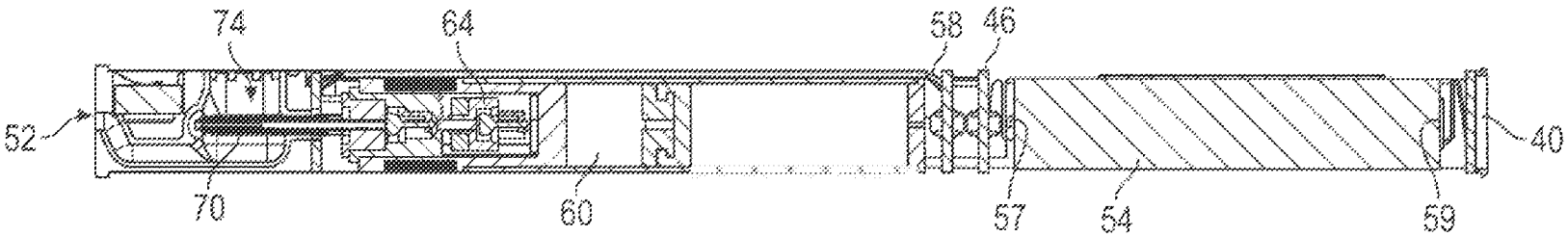
FIG. 4 is a section view of the device as shown in FIG. 3.
Figure 5:
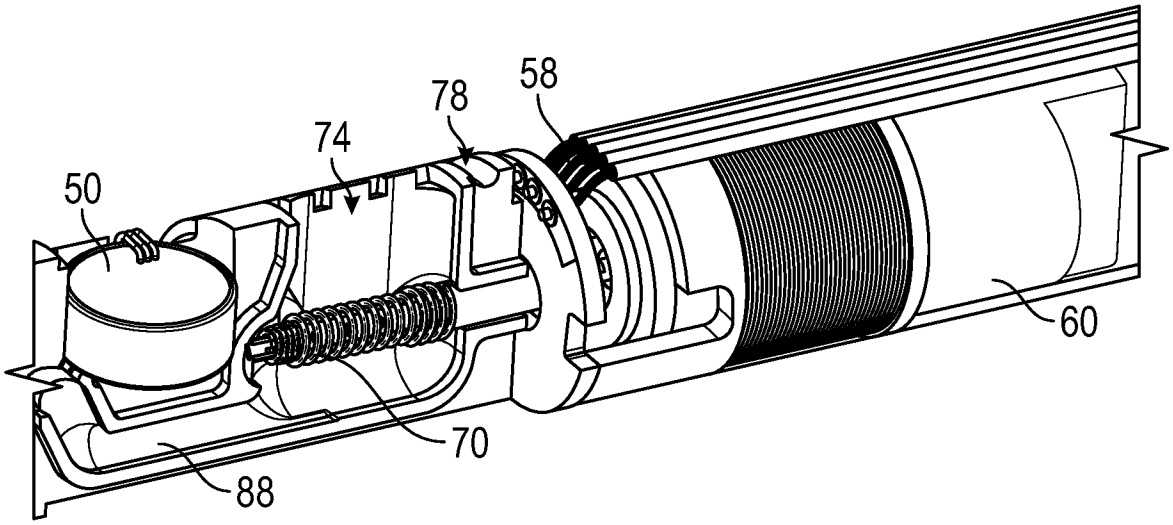
FIG. 5 is an enlarged perspective view of the heater of the device of FIGS. 1-4.

FIG. 1 illustrates an example of an aerosol generating device 30 that is cylindrical and may have a size and shape similar to a tobacco cigarette, typically about 100 mm long with a 7.5 mm diameter, although lengths may range from 70 to 150 or 180 mm, and diameters from 5 to 20 mm. As shown in FIG. 2, the device 30 has a tubular housing 32 which may be a single piece, or may be divided into two or three separate housing sections, optionally including a battery section 34, a reservoir section 36 and a heater section 38. An LED 40 may be provided at the front end of the device 30 with an outlet 52 at the back end of the device 30.

In the example shown, a battery 56 and a liquid reservoir 60 are contained within the housing 32. The liquid reservoir 60 contains a liquid, such as a liquid nicotine formulation. A pump 64 is located behind or within the reservoir 60. The pump (e.g., a piston pump or diaphragm pump) can be mechanically or magnetically coupled to a pump motor 80. A check valve 82 allows a volume of liquid to flow from the reservoir 60 to the pump 64 for subsequent delivery to a heater 70. The heater 70 may be in the form of a wire coil. The reservoir may have floating end cap that moves to prevent vacuum conditions in the reservoir as liquid is consumed.

Figure 10:
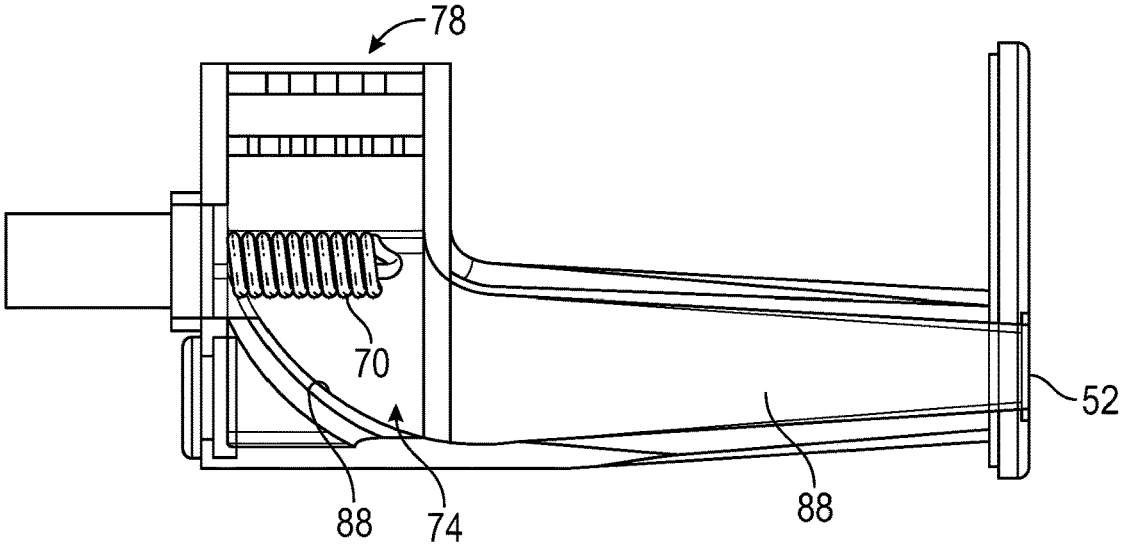
FIG. 10 is a side view of the vaporization chamber.

Alternatively, the heater may be provided in the form of a cylinder or plate of a screen or ceramic material, or a honeycomb or open lattice framework. The heater 70 is positioned within a aerosolization chamber 74 leading from an air inlet 78 to a duct 88 connecting to the outlet 52. The outlet 52 can optionally be in a mouthpiece 84 which is removable from the housing 32. The inlet 78 can be a single hole or a plurality of holes or slots. As shown in FIG. 10, the aerosolization chamber 74 may have an arc section 86 below the heater 70 (as oriented in the Figures) to better redirect air flow from perpendicular to the heater to parallel to the heater 70, as air flows through the aerosolizing chamber 74, into the duct 88 and out via the outlet 52. In the duct 88, the aerosol particles aggregate to the intended size.

The pump motor 80 may be located outside of the reservoir 60 and is mechanically or magnetically coupled to a piston 120 moveable within the pump. In operation, the pump motor 80 moves the piston 120 to deliver a volume of a liquid from the reservoir 60 onto the heater 70, with the heater 70 vaporizing the liquid. Air flowing through the air inlet 78 causes the vaporized liquid to condense forming an aerosol having a desired particle diameter within the vaporization chamber, prior to the aerosol flowing through the outlet 52. The pump motor 80 can be a magnetic motor designed to oscillate at a slow frequency (e.g., between 1 and 10 Hz). The volume pumped per stroke is determined by the preset stroke length and the diameter of the piston chamber. The electronic controller 46 can control for variability in battery condition and ensure consistent heating by direct measurement of resistance through the heater to control for changes in battery voltage/charge.

Figure 6:
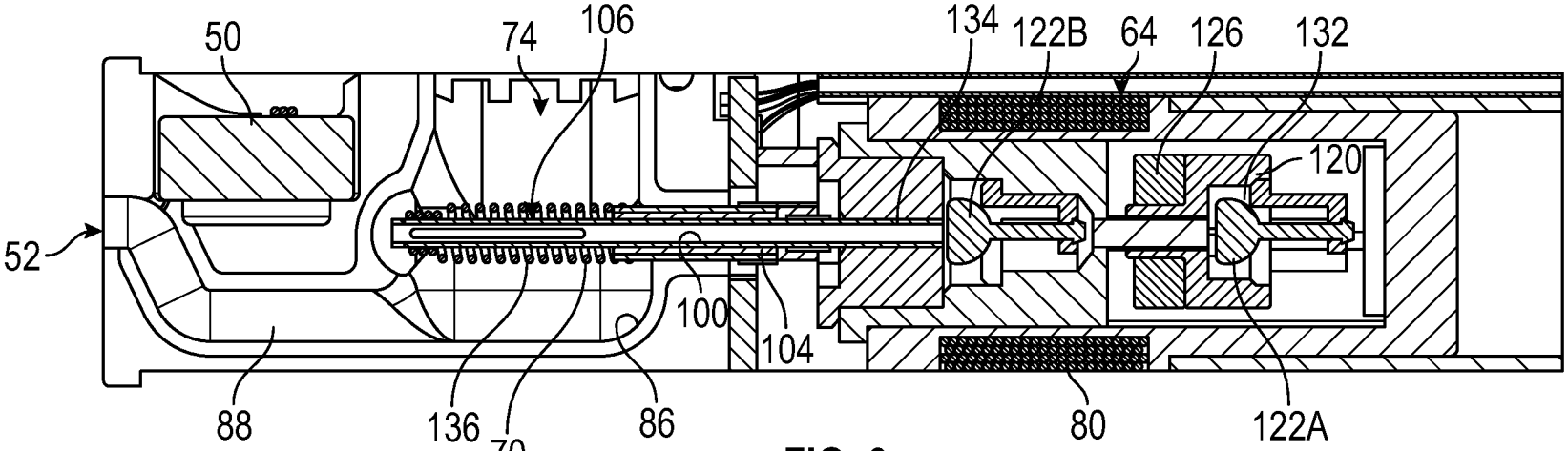
FIG. 6 is an enlarged section view of the pump of the device as shown in FIG. 5.
Figure 7:
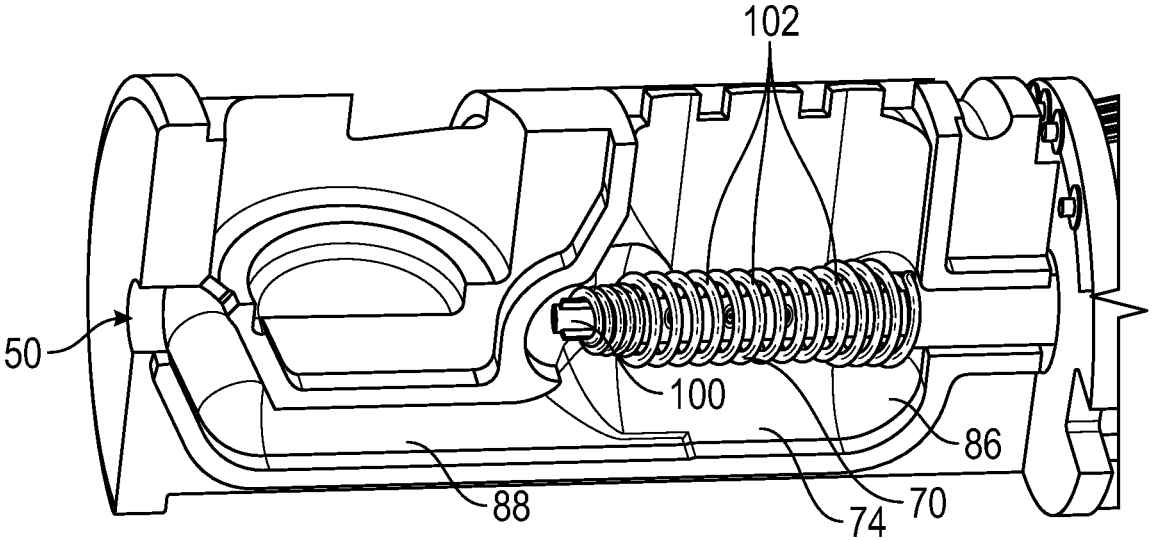
FIG. 7 is a further enlarged perspective view of the vaporization chamber of the device of FIG. 1.

In FIG. 6, a tube 100 connects the reservoir 60 to the heater 70. The tube can be metal or an electrically resistive material. The tube 100 can be welded to an end of the heater 70. As shown in FIG. 7, the heater 70 is a coil wrapped around an end of the tube 100, with the heater coil having a length of 2-8 mm. In the example shown, the heater 70 is a 0.2 mm diameter stainless steel wire with about 9 to 12 coil loops concentric with the tube 100. The heater coil can have an end crimped into or onto an end of the tube 100 to form an electrical connection to the tube and to close off the end of the tube 100. The section of the tube 100 within the heater 70 may be referred to as a dispensing needle and it is generally concentric with the heater coil.

Figure 9:
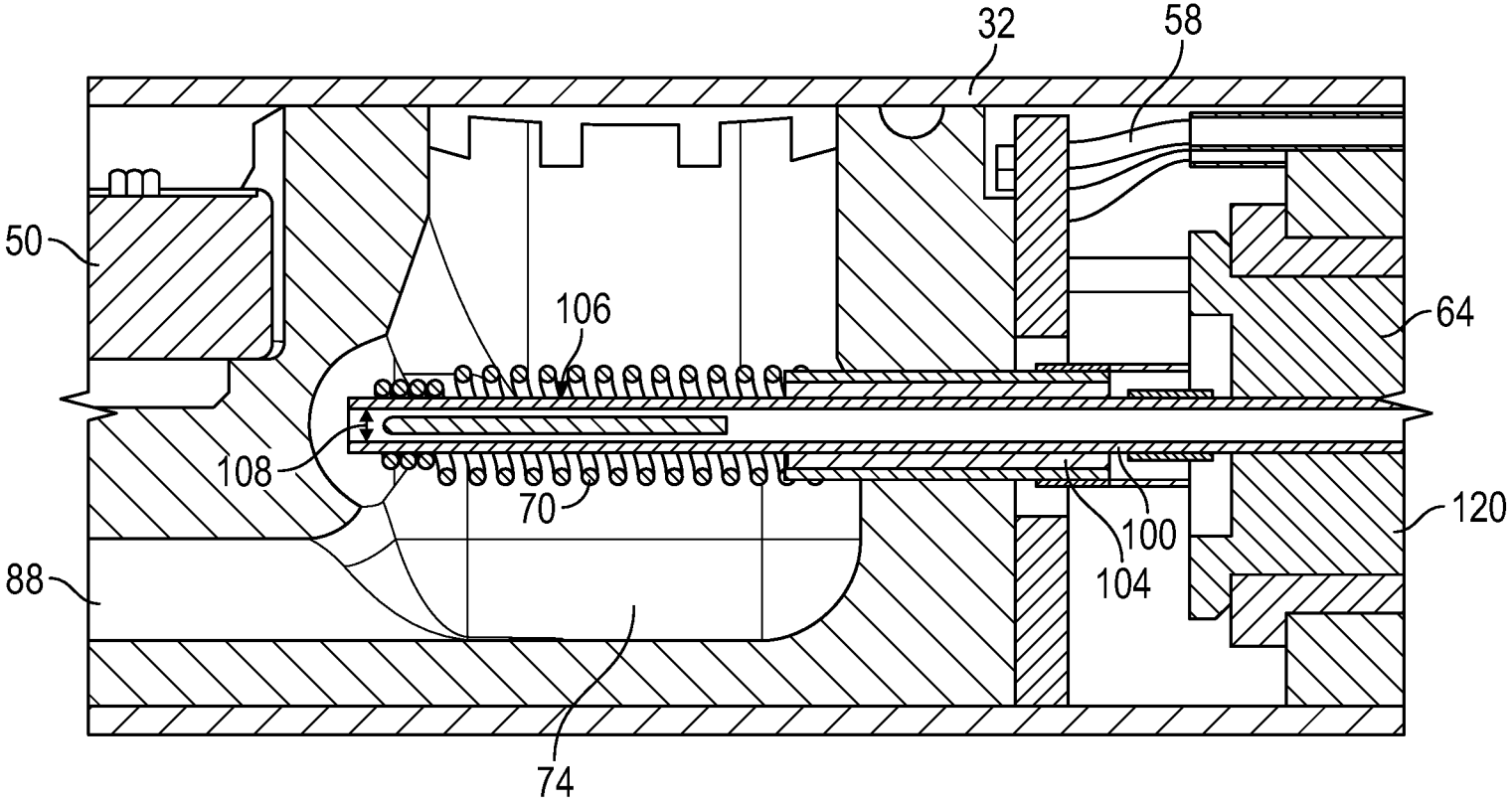
FIG. 9 is a section view showing details of the heater.

Referring to FIG. 9, the tube 100 has an outside diameter of 0.8 to 2 mm or 1 to 1.5 mm. The annular gap spaces the outside diameter of the tube 100 apart from the central section of the heater coil and is typically 0.1 to 0.5 or 1 mm, or 0.2 to 0.4 mm. The spacing between adjacent coil loops is generally 0.2 to 0.8 mm. Consequently, surface tension tends to hold the liquid within or around the heater coil. Also as shown in FIG. 9, the downstream end of the tube 100 may optionally simply be closed off using a plug 108, rather than via crimping or welding.

As further shown in FIG. 7, the tube 100 has tube outlets 102 surrounded by the heater 70. The outlets 102 may be aligned on a common axis or they may be staggered or radially offset from each other. A portion of the tube 100 between the reservoir 60 and the heater 70 can be surrounded by a sleeve 104 to insulate the tube 100. The heater coil may be spot welded to the sleeve 104. In use electrical current flows through the heater 70 by connecting the battery 56 to the tube 100 and the sleeve 104. In this example, the portion of the heater connected to or sealing the end of the tube as well as the portion of the heater connected to the sleeve 104 can serve as electrical contacts that serve to electrically couple the heater to the battery. The battery can be a 3.8 volt lithium battery with roughly 200 milliamp-hours of electrical energy, generally sufficient to last up to a day of moderate use. The battery 56 is typically cylindrical with the electrodes or contacts 57 and 59 on the flat opposite ends of the battery, and with a potential of 1 to 12 volts.

Referring back to FIG. 6, the valve 122A opens and allows liquid to enter the piston chamber 132 when the piston 120 moves away from the input end of the tube 100 and closes when the piston 120 moves towards input end of the tube 100. Alternating or cycling movement of the piston 120 pumps the liquid from the input end 134 of the tube 100 distally toward an outlet end of the tube 100 at or near the heater 70 surrounding the outlet end 136 of the tube 100. A second valve 122B between the input end of the tube 100 and the outlet end of the tube 100 opens when the liquid is being delivered to the heater 70 and closes when the piston 120 is being refilled, to prevent any liquid being pulled backwards from the heater 70 into the piston chamber 132. Closing of the valve 122B can be designed to close of the end of the tube 100 once inhalation has stopped, to seal off the reservoir and preclude or prevent any seepage or leaking of liquid onto the heater 70 between puffs or inhalations. The valve 122B can be moved to the closed position via a magnet 126 or a spring.

The region of the tube 100 over which the piston 120 slides can have an outer diameter of 1 mm. In sliding over the tube 100, the piston 120 can travel about 0.5 to 1 mm or about 0.75 mm such that a volume of about 0.4 to 0.6 ml of a liquid is pumped with each stroke of the pump, with volumes per stroke of about 0.3 to 0.7 ml typical. With the pump operating at 5 Hz, 2 ml/second of liquid are supplied to the heater 70 in the example shown.

Figure 11:
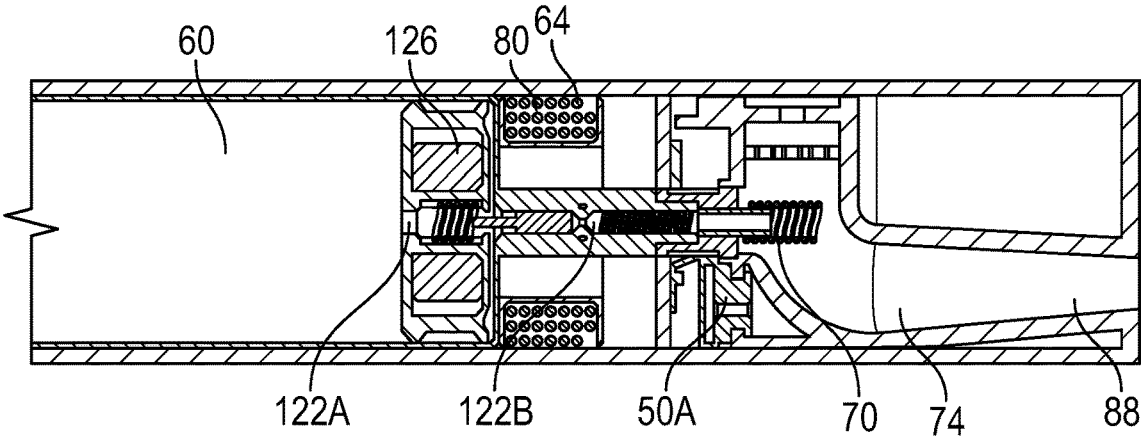
FIG. 11 is a perspective section view of the pump.

In operation, a user inhales on the outlet 52 of the device 30 such that the inhalation can be sensed by the sensor 50. Upon detection of the inhalation, the sensor 50 activates the heater 70 through the electronic controller 4. Additionally, upon detection of inhalation, the electronic controller 46 activates the pump 64 to deliver a volume (i.e., dose) of the liquid from the reservoir 60 into the tube 100. As shown in FIG. 11, a sensor 50A may be located adjacent to the pump, optionally with a sensor probe connecting into the aerosolization chamber 74.

After the liquid is pumped into the tube 100, the dose of liquid is moved through the tube by positive displacement from the pump 64. A chamber section or portion 106 of the tube 100 is disposed within the aerosolization chamber 74 and surrounded by the coil heater 70. The liquid is pumped out of the tube 100 through the tube outlets 102 in the chamber section 106 of the tube. The outlets 102 act as ejection ports such that the fluid pressure from the pump ejects the liquid through the outlets 102 and onto the heater 70. The tube 100 can have 1, 2, 3, 4, 5, 6, 7, 8, 9 or 10 tube outlets 102, with the outlets having a diameter of from 0.2 to 0.5 mm. Three tube outlets 1012 are used in the example shown.

Figure 8:
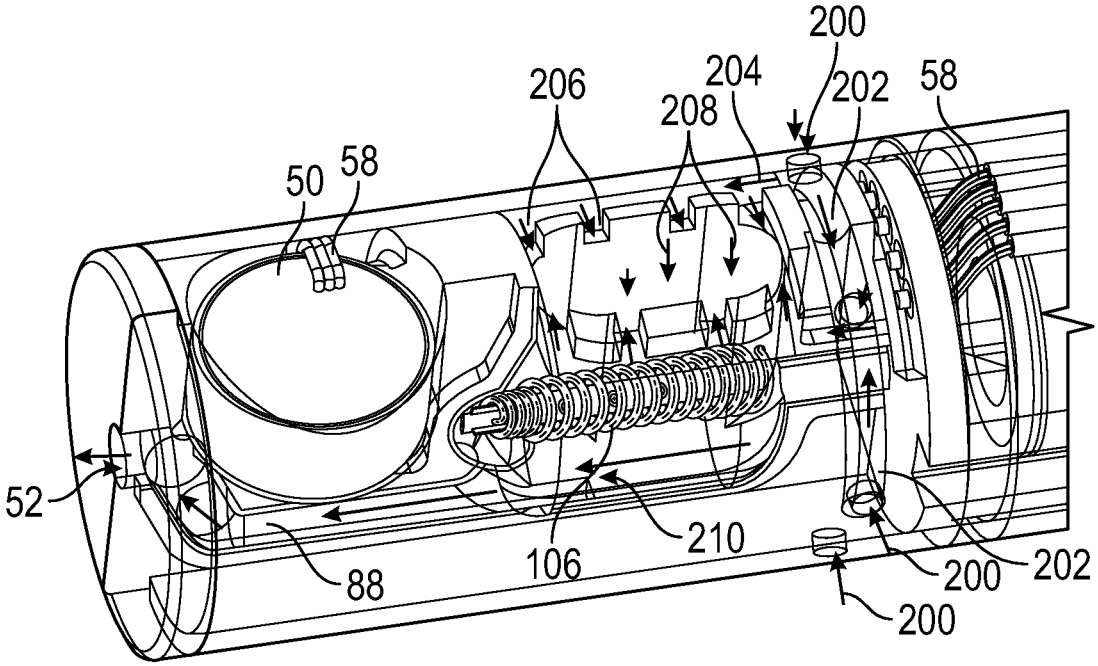
FIG. 8 is a diagram showing air flow.

Referring to FIG. 8, the device 30 is configured to rapidly cool and condense vaporized nicotine mixture into a condensation aerosol. The particles in the aerosol continue to rapidly aggregate and grow due to collisions of the particles into even larger particles while still within the airway. This aggregation continues until a relatively stable aerosol of an appropriately sized aerosol is reached. When the user inhales, air enters the device through inlet holes 200, which may be located around the periphery of the device about 2.5 cm from the outlet 52 of the device. The inlet holes are typically round and each inlet hole may have a diameter of 0.4 to 1.2 mm. Generally four, six or eight inlet holes are spaced around the circumference of the cylindrical housing. The air is then routed along a channel 202 around the periphery of the airway and flows through two metering slots 204 used to define the inhalation resistance through the device. The slots 204 may be holes with a diameter of 0.8 mm; next the air the air flows through eight slots 206 arranged around the inlet 208 of the airway, which distribute the air over the entire cross section of the airway. Each of the slots 206 may be 8 mm long and from about 0.7 mm to about 1 mm wide.

The air then flows into the entrance of the airway and across the heater, perpendicular to the longitudinal axis of the heater. Finally the air flows through the duct 88 downstream of the heater with the vaporized nicotine mixture and out of the outlet 52. The inhalation resistance of the device in this example is approximately equal to the flow resistance of a tobacco cigarette, and thereby facilitated a mouth breathing maneuver (i.e., puffing) from the user of the device.

Upon movement of the dose of liquid through the tube outlets 102, the liquid contacts the heater 70 and is vaporized. The vaporized liquid flows through the chamber 74 in the inhaled air stream i.e., in air flowing between the inlet 78 and outlet 52. The air flows at a flow rate (about 1 to about 10 lpm) effective to condense the vaporized liquid into an aerosol having a diameter (MMAD) of from about 1 micron to about 5 microns. Subsequently, the flows through the outlet 52 of the device and is inhaled to the deep lungs of the user.

Figure 12:
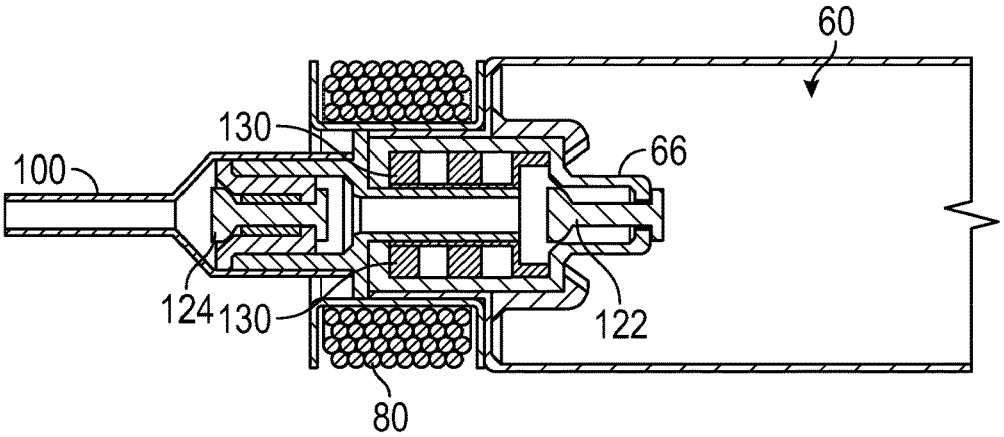
FIG. 12 is a perspective view of an alternative pump.

FIG. 12 shows an alternative reservoir cartridge including a pump having piston magnets 130 in between a first valve 122 and a second valve 124, with the piston magnets 130 used to control movement of the piston.

The device 30 may be designed to produce an aerosol with a particle size in the 1 micron to 3 micron range. Aerosol particles in the 1 micron to 3 micron range can settle in the lung much more efficiently than smaller particles and are not readily exhaled. The devices and methods described here provide an electronic cigarette that can more closely replicate the nicotine deposition associated with tobacco cigarettes. The device 30 can provide a nicotine pharmacokinetics profile (PK) having the sensory effects associated with tobacco cigarette smoking.

The device 30 may be designed to produce particles having a mass median aerodynamic diameter (MMAD) of from about 1 to about 5 μm. The particles can have a geometric standard deviation (GSD) of less than 2. The aerosol can be generated from a formulation having a pharmaceutically active substance. The formulation can be in a liquid or solid phase prior to vaporization. The substance may be nicotine, optionally stabilized using one or more carriers (e.g., vegetable glycerin and/or propylene glycol). The liquid formulation can have 69% propylene glycol, 29% vegetable glycerin and 2% nicotine).

The device 30 can have an flow resistance that is low enough to enable the user to inhale directly into the lung. Low flow resistance can be generally advantageous for deep lung delivery of an substance, such as nicotine, and to enable rapid nicotine pharmacokinetics (PK). tobacco cigarettes can have a high enough flow resistance to preclude direct to lung inhalation thereby requiring the user to inhale, or puff, by using a mouth breathing maneuver.

The aerosol can be further entrained in an entrainment flow of air supplied by one or more secondary passageways or inlets coupled to the chamber 74, as further described below relative to FIGS. 19-22. The entrainment flow of air can entrain the aerosol in a flow effective to deliver the aerosol to the deep lungs of the user using the device. The primary entrainment flow can be from about 20 lpm to about 80 lpm, and the secondary entrainment flow can be from about 6 lpm to about 40 lpm.

The amount of the liquid formulation delivered by the pump may be controlled by setting a pump rate such that a specific pump rate corresponds to a specific volume delivered by the pump. Adjusting the pump rate from a first pump rate to a second pump rate can result in the pump delivering a different amount or volume of liquid formulation. The pump can be set at a first controlled rate such that a first amount of liquid is delivered to the heater which generates a first aerosol having a first size (e.g., diameter) and the pump rate is then changed to operate at a second controlled rate such that a second amount of the liquid is delivered to the heater which generates a second aerosol having a second size (e.g., diameter).

The first and second aerosols can have different sizes (e.g., diameters). The first aerosol can have a size (e.g., diameter) suitable for delivery and absorption into the deep lungs, i.e., about 1 μm to about 5 μm (mass median aerodynamic diameter or visual mean diameter). The second aerosol can have a size (e.g., diameter) suitable for exhalation from a user of the device such that the exhaled aerosol is visible, i.e., less than about 1 μm. Alteration of the rates of the pump can occur during a single puff or use of the device by a user. Alteration of the pump rate during a single use can occur automatically or manually, or during separate uses of the device by a user.

Automatic alteration of the pump rate can be accomplished by electrically coupling the pump to a circuit configured to switch the pump rate during operation of the device. The circuit can be controlled by a control program. The control program can be stored in the electronic controller 46, which may be programmable. A user of the device can select a desired aerosol size or sets of aerosol sizes by selecting a specific program on the electronic controller 46 prior to use of the device 30.

A specific program can be associated with a specific pump rate for delivering a specific volume of a liquid formulation in order to produce an aerosol having a desired size. If the user desires an aerosol with a different size (e.g., diameter) for a subsequent use, then the user can select a different program associated with a different pump rate for delivering a different volume of the liquid formulation in order to produce an aerosol with the newly desired size (e.g., diameter). A specific program may be associated with specific pump rates for delivering specific volumes of a liquid formulation in order to produce multiple aerosols having desired sizes. Each of the specific pump rates in a specific program can deliver in succession a specific volume of the liquid in order to produce a succession of aerosols of differing sizes (e.g., diameters) during a single use of the device.

Manual alteration of the pump rate can be accomplished by the user of the device pressing a button or switch 54 on the device during use of the device. Manual alteration can occur during a single use of the device or between separate uses of the device. The button or switch is electrically coupled to the electronic controller 46. The electronic controller 46 can have program(s) designed to control the operation of the pump such that the pressing the button or switch 54 causes the electronic controller to alter the operation (e.g., pump rate) of the pump in order to affect delivery of a differing volume of the liquid formulation. The user of the device can press the button or flip the switch 54 while using the device or between uses of the device.

The aerosol generating device may be configured to produce an aerosol having a diameter of from about 1 μm to about 1.2 μm. Upon inhaling from an outlet of the device, a user can perform a breathing maneuver in order to facilitate delivery of the aerosol having a diameter of from about 1 μm to about 1.2 μm into the user's deep lungs for subsequent absorption into the user's bloodstream. The user can hold the breath during the breathing maneuver following inhalation of the aerosol and subsequently exhaling. The breath-hold can be for 1, 2, 3, 4, 5, 6, 7, 8, 9, or 10 seconds. The breath-hold can be from about 2 to about 5 seconds. Alternatively, the user can inhale and directly exhale the aerosol having a diameter of from about 1 μm to about 1.2 μm. Inhalation followed by direct exhalation can cause the generation of a visible vapor since a large percentage of the aerosol can be exhaled.

The user may select whether or not the user wants an aerosol generated by the aerosol generating device to be delivered to said user's deep lungs (e.g., alveoli) or be exhaled as a visible vapor. The device 30 may be configured to produce an aerosol size (e.g., aerosol diameter of about 1 micron) such that if a user of the device exhales directly without performing a breath hold, a majority or significant amount of the aerosol is exhaled as a visible vapor. The majority or the significant amount can be more than or greater than 50%, 60%, 65%, 70%, 75%, 80%, 85%, 90%, 95% or 99%. In this manner, the user of the aerosol generating device can choose during use of the device if they desire deep lung delivery and/or production of a visible vapor.

Figure 13:
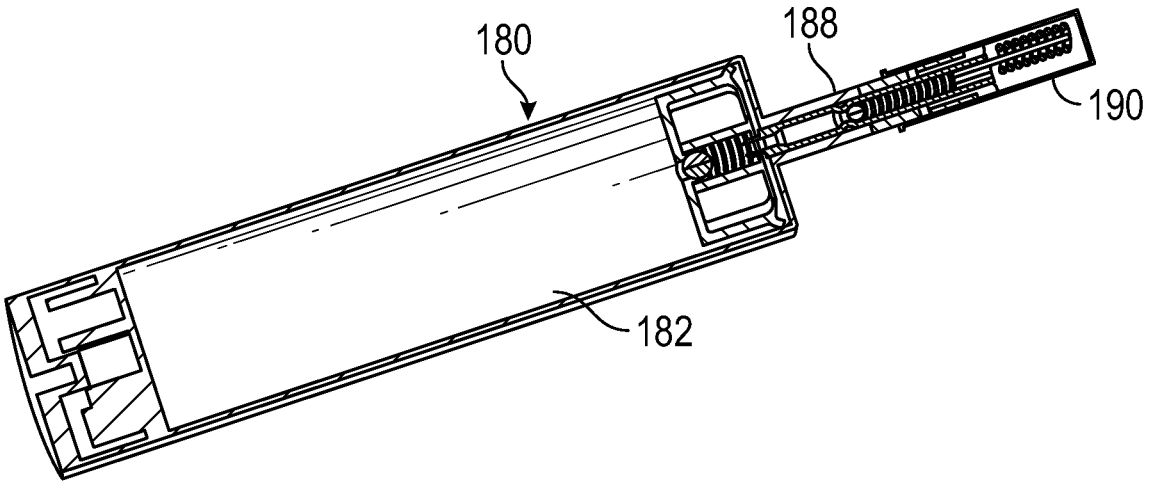
FIG. 13 is a section view of a pump cartridge shown in FIG. 12.
Figure 14:
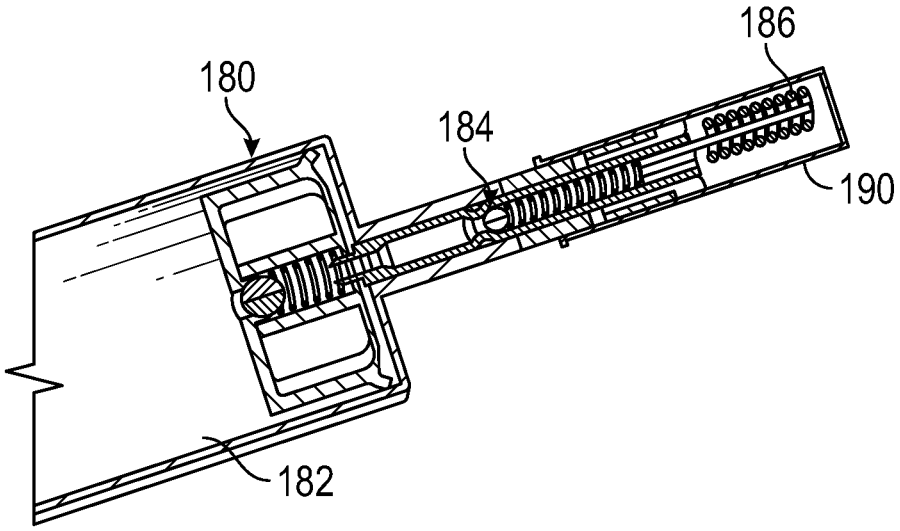
FIG. 14 is an enlarged section view of the pump of the pump cartridge of FIG. 13.
Figure 15:
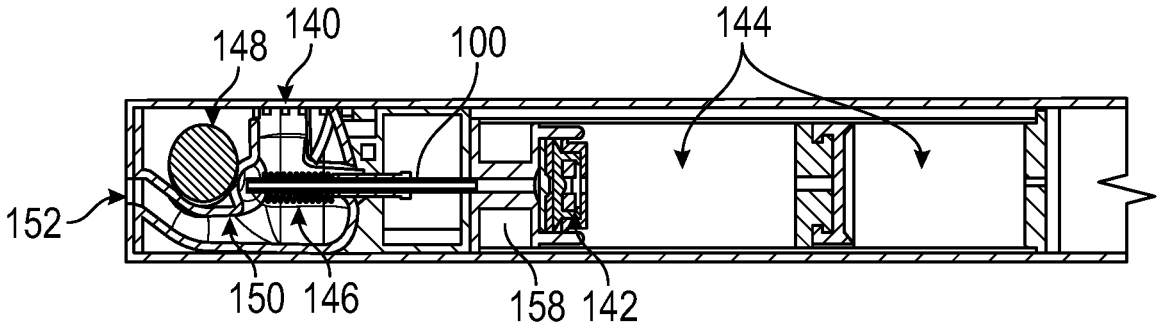
FIG. 15 is a perspective section view of an alternative aerosol generating device.

As shown in FIGS. 13 and 14, a cartridge 180 having a liquid reservoir 182 includes a cartridge pump 184 connected to an elongated housing 188 having a heater 186 at the tip. The elongated housing 188 can be surrounded by a retractable heater cap 190 provided to protect the heater when the cartridge is not installed into a device 30. The heater cap 190 may be retracted when the reservoir is inserted or connected to a separate component to form an aerosol generating device. The cartridge 180 can be one component in a multi-component aerosol generating device. The cartridge can be disposable or refillable.

In the example shown in FIGS. 1-9, the reservoir may be refillable, non-replaceable and configured to hold 2 mg of a nicotine liquid mixture. At a 2% nicotine concentration, this size reservoir provides 40 ml of nicotine. If 40 mg of nicotine is assumed to roughly equal 40 burning tobacco cigarettes in terms of delivered nicotine, then the reservoir in the device in this example lasts between 1-3 days, depending on the intensity and frequency of use. The reservoir may be replaceable. A device 30 having a replaceable cartridge may be designed to: 1.) replace the cartridge only; 2.) replace the pump interior (not the magnetic solenoid with the cartridge); or 3.) replace the heater and pump interior with the cartridge. In this type of device, the non-replaceable portion of the device includes the battery and the electronics. The non-replaceable portion may also contain the vaporization chamber 74. In each of these configurations, the liquid may be held in rigid container or in a collapsible bag. If used, the collapsible bag may be constructed from multi-layer laminate material to preserve the purity of the liquid. In operation, as liquid is consumed, the bag collapses.

In methods for aliquoting an substance (e.g., nicotine) to ensure dose-to-dose uniformity, an element having porous materials can wick out fluid at a particular rate in order to measure out a dose to provide dose-to-dose uniformity. A tube, e.g., a capillary tube can be used to measure out a dose, with heat used for ejecting a dose. A material or geometry of a device can be used to measure out a dose providing dose consistency controls for variability in environment and device. Inhalation flow control ensures that variability in inhalations by a user are controlled and corrected for, which can result in dose-to-dose consistency and predictable and desirable aerosol particle sizes.

The liquid may be metered out into a pre-vaporization area in a device (dosing mechanism) through capillary action. The metering can occur between inhalations of a user of a device. Upon inhalation by a user, liquid can be drawn into a vaporization chamber or onto a heater. The liquid can be drawn or metered out into a vaporization chamber or onto a heater upon inhalation by a user.

The vaporization device may include elements for separating out and reducing large aerosol particles to a size that can navigate to the deep lung of a user. In the deep lung, the particles can settle and be rapidly absorbed. For example, the aerosol size control can result in rapid, cigarette-like nicotine absorption, which can help to satisfy nicotine cravings. Aerosol particles having nicotine produced by the device can achieve peak plasma concentrations similar to peak plasma concentrations achieved by smoking a cigarette.

The device 30 may allow the user to vary the flow resistance, to better provide either deep lung delivery or replicate the puffing of a tobacco cigarette. By varying both the size of the inlet that controls the flow through the vaporization region and the size of the bypass or secondary inlet, the user can control the flow resistance through the device and the resultant aerosol particle size. The flow resistance can be varied over time, for example over a month, days, hours, or minutes. The flow resistance can be varied within the same "smoking session."

For example, a user can select a high flow resistance and small particle size to more closely replicate the sensation, perception or the nicotine pharmacokinetics (PK) associated with smoking a tobacco cigarette. A user can select or alter a flow resistance/particle size after several initial deep inhalations. A user can select the flow resistance/particle size to: maximize the nicotine hit or sensation within a series of inhalations (e.g., thereby reducing nicotine cravings), or to focus more on the sensory aspects of the vaping experience, e.g., to produce a large visible cloud of vapor. It can be advantageous in some settings to use a larger aerosol with little or no visible exhaled vapor.

FIGS. 15-18 show an additional example of an aerosol generating device having a tubular housing, an inlet 140, an outlet 152, a pump 142, a reservoir 144, a heater 146, a sensor 148 and an airway 150. As with the device 30 shown in FIGS. 1-9, the inlet 140 can be a single hole or a plurality of holes. The airway 150 can be a single passageway or configured with a primary passageway and one or more secondary passageways connecting into the primary passageway, generally downstream of the heater.

Figure 17:
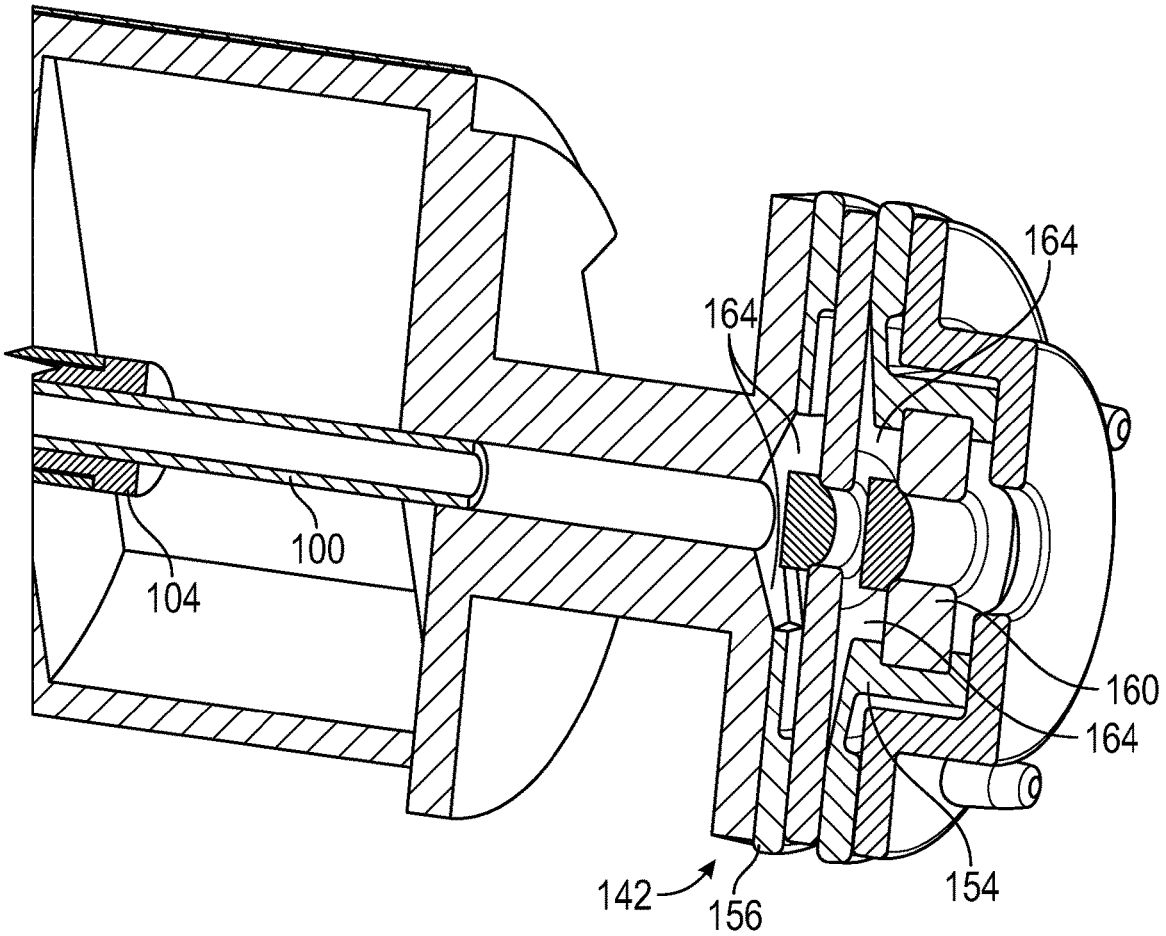
FIG. 17 is an enlarged section view of the pump shown in FIG. 16.

As shown in 17 and 18, the pump can be a pump having a first elastomeric membrane 154 which vibrates or oscillates back and forth. The pump can be completely or partially housed within the reservoir 144. As shown in FIG. 17, the pump motor 158 can be located adjacent to and outside of the reservoir 60 and can be a solenoid coil. In this design the electrical components of the pump are not exposed to the liquid. The pump 142 can have a magnet 160 held in the first elastomeric membrane 154 and used to control movement of the pump 142. The pump 142 can further have a second elastomeric membrane 156 that can serve as valve for the liquid to enter a tube that terminates with a dispensing needle as described configured to eject or ooze the liquid onto the heater.

Figure 16:
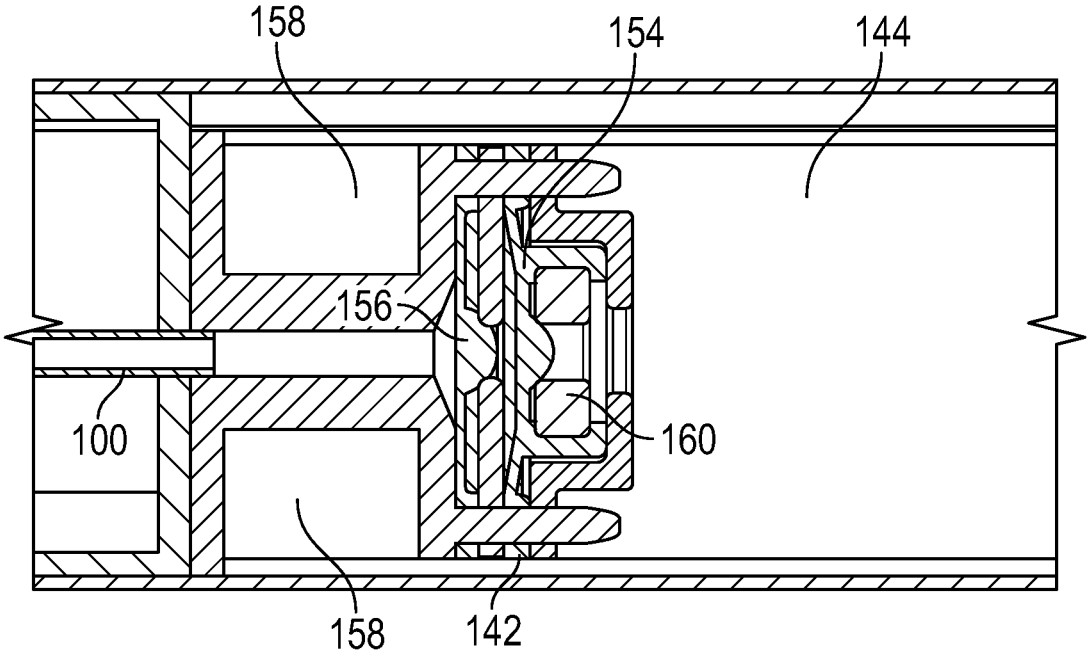
FIG. 16 is an enlarged section view of the device of FIG. 15.
Figure 18:
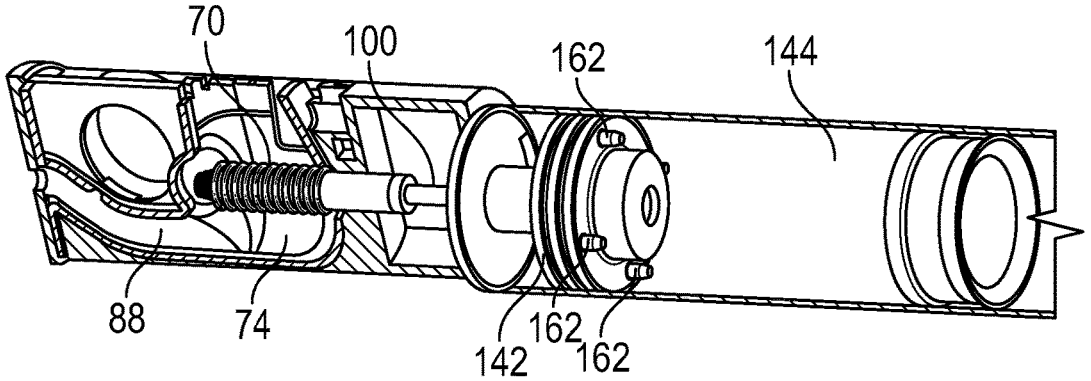
FIG. 18 is a section view of components of the pump shown in FIG. 17.
Figure 19:
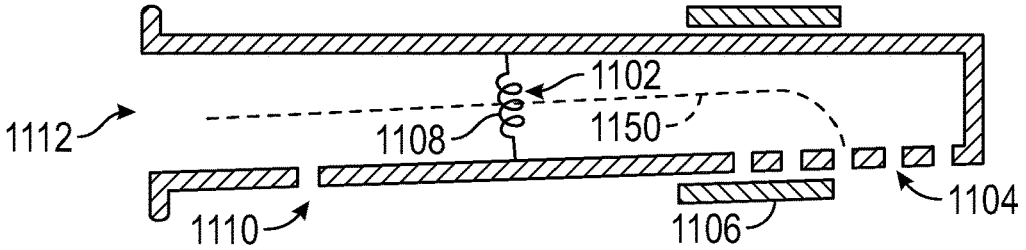
FIG. 19 is a diagram of a device having a mouth piece, a bypass air, a heater, a slide, inlet holes, and a slide of a device for generating an aerosol.

As shown in FIG. 19, the components of the pump shown in FIG. 16-18 can be held together with pins (e.g., pins 162). FIG. 18 shows the slots or holes 164 within the pump 142 through which the liquid can pass into the pump and out of the pump into the tube and dispensing needle. The pump motor 158 may be a solenoid coil made from 36 gage magnet wire having 400 wraps and a resistance of around 10-11 Ohms. Generally, 50 to 1000 wraps are suitable using 32 to 38 gauge wire. If the battery supplies a current of about 0.34 amps through the solenoid coil, the pump 142 is driven at about 5 Hz such that the liquid formulation is pumped at about 2-3 mg/second.

Figure 20:
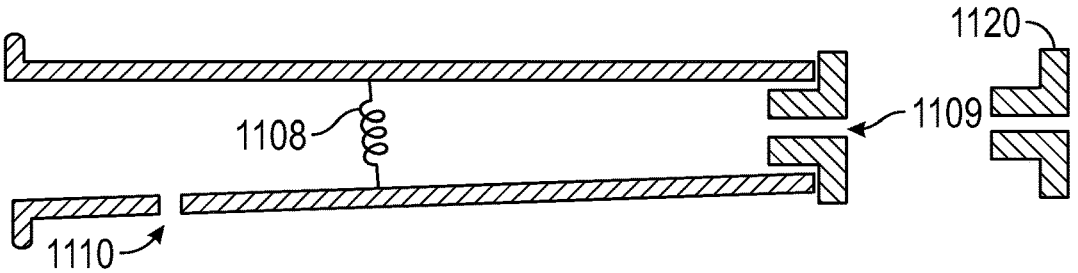
FIG. 20 is a diagram of a replaceable orifice of a device for generating an aerosol.

FIGS. 19 and 20 show optional modifications of the device 30. The particle size provided by a device 30 may controlled by controlling the amount of air that entrains the vaporizing nicotine mixture. Control of flow rate through the vaporization chamber 1102 can be accomplished by controlling the size of the primary air inlet(s) 1104 to the vaporization chamber. By controlling the size of the opening, the resulting particle size can be controlled. The user may vary this opening size to control the particle size, and thereby affect the vaping experience in terms of the amount of visible vapor produced by the device, as well as other sensory characteristics.

Figure 21:
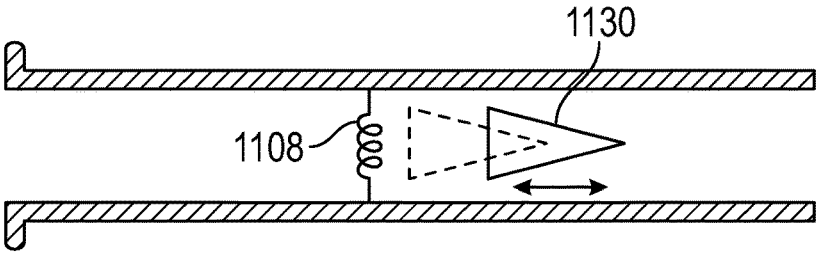
FIG. 21 is a diagram of a baffle slider used to modulate air flow and vaporization in a device for generating an aerosol.
Figure 22:
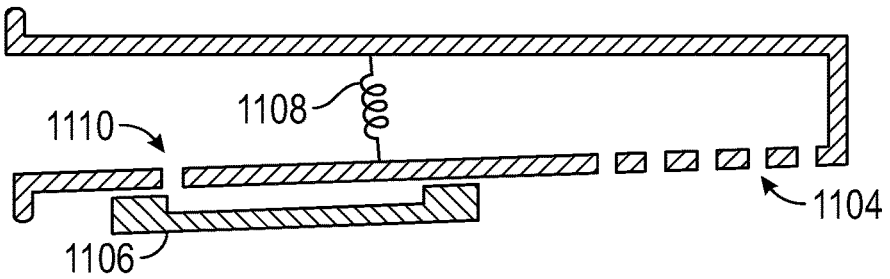
FIG. 22 is a diagram of a slider used to modulate air flow and vaporization in a device for generating an aerosol.

A user may choose a larger particle size (1-3 um) to more closely replicate the nicotine deposition of cigarettes, as well as vape in a more discrete manner, and in another case they may choose a 0.5 um aerosol to more closely mimic the visual aspects of exhaling a visible vapor, like smoking. This can be accomplished by a user manipulated movable adjusting element such as a slide 1106 or other method of varying the entrance opening size as shown in FIGS. 19 and 22. The device can also come with exchangeable orifices 1120 that the user inserts into the device as shown in FIG. 20. Alternatively the device can have a user interface where the user selects the aerosol size and onboard electronics open or close the opening. A baffle slider 1130 may be positioned upstream of a heater 1108. The baffle slider 1130 can be used to divert air around a heater or vaporization region as shown in FIG. 21. The elements shown in FIGS. 19-22 may also of course be used in other devices in addition to the device 30.

A user can switch the inhalation flow resistance and/or particle size characteristics of the vapor to focus more on the sensory aspects of the vaping experience. It can be advantageous in some settings to use a larger aerosol with little or no exhaled evidence where blowing huge plumes and smoke rings is socially unacceptable. In the device of FIG. 19, the slide 1106 can be moved to cover or uncover a primary air inlet 1104 upstream of the heater 1108, or a secondary air inlet 1110 downstream of the heater 1108.

As shown in FIG. 19, the device 30 can have a vaporization chamber 1102 and one or more upstream primary or first inlets 1104 and a downstream outlet 1112. An airflow path 1150 leads into the vaporization chamber. The secondary inlet 1110, if used, allows a substantially laminar flow of air into the airflow path, with the secondary inlet 1110 downstream of the heater 1108.

The device may be capable of modifying a size of the outlet 1112 and/or the inlet 1104 and/or the secondary inlet 1110 via an adjusting element such as the baffle slider 1130. The adjusting element may alternatively be a flow restrictor or a fixed or movable baffle, which may be located upstream of the heater, and optionally configured to slide within the vaporization chamber. A vaporization chamber 1102 can be configured to limit a flow of a gas through the airflow path 1150 to permit condensation of a vaporized liquid formulation.

Figure 23:
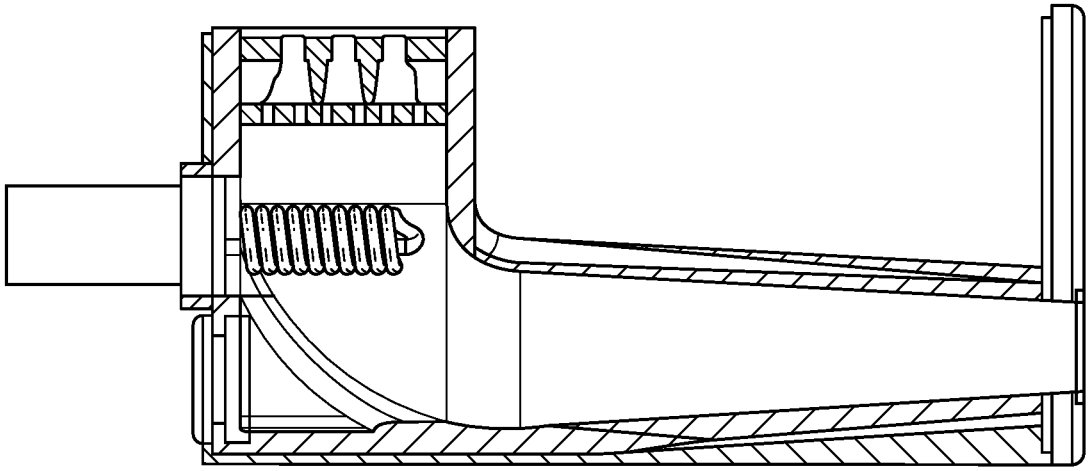
FIG. 23 is a computational fluid dynamic model of the air flow velocities of the airway in the device of FIGS. 1-10.
Figure 24:
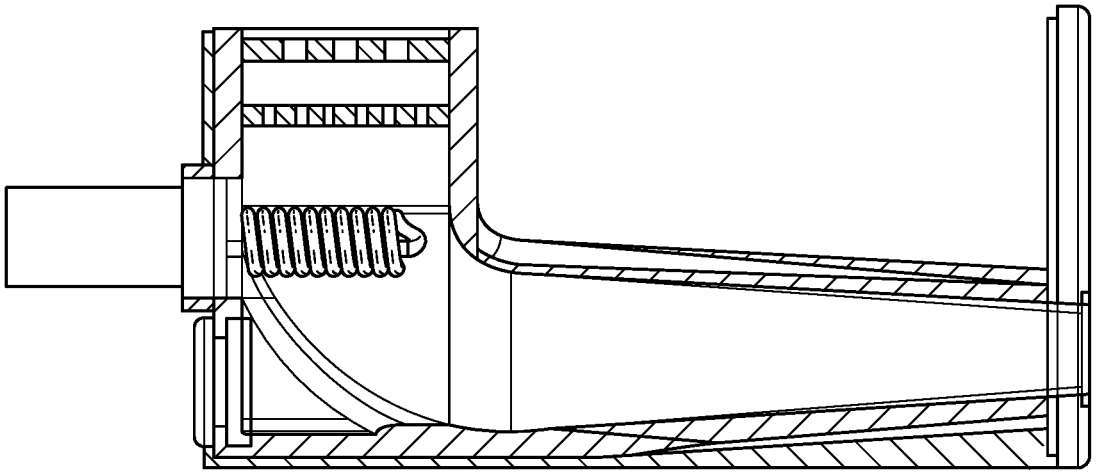
FIG. 24 is a corresponding computational fluid dynamic model of the pressure drops of the airway.

As shown in FIG. 23, the width and/or cross section of the inlet slots 206 may vary, along with air flow velocity through the airway during inhalation. Air flow velocity in the airway under the center slot may be greater than towards the sides, with typical velocities computed to range from about 0.5 m/s towards the sides up to about 3.5 m/s towards the center. FIG. 24 is a computational fluid dynamic model of pressure drops given in absolute values with 1033 cm (407 inches) H2O representing atmospheric pressure. Inhalation flow resistance in this example was 30 cm $H_2O$ at 1.5 liters/minute. As shown in FIG. 24, the pressures in the airway between the inlet slots and the heater (998 cm or 395 inches H2O) is computed to be the same as at the outlet 52.

The solenoid coil can be made from 36 gage magnet wire. In some cases, the solenoid coil comprises 36 gauge magnet wire that has a resistance of around 10-11 Ohms. The 10-11 Ohms resistance of the solenoid coil can be achieved with a solenoid coil having 400 wraps. The battery may supply a current of about 0.34 amps through the solenoid coil such that the pump is driven at about 2 to 10 or 4-6 Hz such that the liquid formulation is pumped at about 1-4 or 2-3 mg/second. Pump frequencies of 1 up to about 100 may be used depending on the pump design. Piston diameters of 0.5 to 5 mm may be used. The magnet in the pump may be a ring magnet with an interior diameter of 1-2 or 1.5 mm, an outside diameter of 4-6 mm or 4.7 mm, and a length of 1-2 mm or 1.5 mm. The distance between successive coils or the pitch of the heater coil may be from about 0.2 to 5 or 0.2 to 0.8 mm.

While preferred embodiments have been shown and described herein, it will be obvious to those skilled in the art that such embodiments are provided by way of example only. Numerous variations, changes, and substitutions can of course be made without departing from the spirit and scope of the invention. The invention, therefore, should not be limited, except by the following claims and their equivalents.

The invention claimed is:

1. A device for generating an aerosol, comprising:

a liquid reservoir for holding a liquid;

a tube made of an impermeable material, the tube having an open first end and a closed second end, and plurality of spaced apart tube outlets in a sidewall of the tube;

a heater wound around the tube, the heater comprising a wire coil surrounding the tube at a position where surface tension holds the liquid within the wire coil, the heater in an aerosolization chamber having one or more air inlets on a first side of the aerosolization chamber for providing air flow across the heater in a direction perpendicular to a longitudinal axis of the tube, the aerosolization chamber having a duct providing an air outlet, the duct on a second side of the aerosolization chamber opposite from the first side, the duct extending in a direction parallel to the longitudinal axis of the tube; and a pump positioned to pump liquid from the liquid reservoir into the open first end of the tube, with all of the pumped liquid moving out of the tube through the tube outlets, and onto the heater.

2. The device of claim 1 further including a battery having a first electrode electrically connected to a first end of the wire coil and a second electrode electrically connected to the tube.

3. The device of claim 1 further comprising an electronic controller electrically connected to a battery, to the pump, to the heater, and to a sensor adapted for sensing inhalation at the air outlet, with the electronic controller activating the pump and the heater upon sensing inhalation.

4. The device of claim 1 wherein the tube is round, the tube outlets extend radially outward through the sidewall of the tube, and the wire coil is concentric with the tube.

5. The device of claim 1 wherein the duct is offset from a central longitudinal axis of the device.

6. The device of claim 1 further comprising a tubular housing, with a battery at a first end of the tubular housing and the air outlet at a second end of the tubular housing, and with the reservoir between the battery and the pump, and with the pump between the reservoir and an aerosolization chamber.

7. The device of claim 6 with the tube parallel and concentric with the tubular housing.

8. A device for generating an aerosol, comprising:

a tubular housing having a first end and a second end;

a liquid reservoir in the tubular housing for holding a liquid;

an aerosolization chamber in the tubular housing;

a wire coil wound around a hollow tube at a position where surface tension holds the liquid within the wire coil, the hollow tube made of an impermeable material, the hollow tube in the aerosolization chamber, the hollow tube having a plurality of tube outlets through a cylindrical sidewall of the hollow tube;

a pump in the tubular housing at first end of the hollow tube, the pump connected to pump liquid from the reservoir into the hollow tube, and through the hollow tube through the tube outlets, and onto the wire coil; and one or more air inlets leading into the aerosolization chamber, the one or more inlets on a first side of the aerosolization chamber for providing air flow across the wire coil in a direction perpendicular to a longitudinal axis of the hollow tube, the aerosolization chamber having a duct providing an air outlet, the duct on a second side of the aerosolization chamber opposite from the first side, the duct extending in a direction parallel to the longitudinal axis of the hollow tube.

9. The device of claim 8 with the wire coil concentric with the hollow tube and with wire coil spaced apart from the hollow tube by an annular gap, the hollow tube having a closed second end, wherein all of the pumped liquid moves out of the hollow tube and onto the wire coil through the tube outlets.

10. The device of claim 8 further comprising a second inlet configured to permit a laminar flow of air into the tubular housing downstream of the wire coil.

11. The device of claim 10 further including a fixed or movable baffle or flow restrictor upstream of the wire coil for adjusting air flow into the vaporization chamber to change the particle size of an aerosol produced in the vaporization chamber.

12. A device for generating an aerosol, comprising:

a liquid reservoir for holding a liquid;

a tube made of an impermeable material, the tube having an open first end and a closed second end, and plurality of spaced apart tube outlets in a sidewall of the tube;

a heater coil wound around the tube in a position where surface tension holds the liquid within the heater coil;

a pump positioned to pump liquid from the liquid reservoir into the open first end of the tube, with all of the pumped liquid moving out of the tube through the tube outlets, and onto the heater coil;

the heater coil in an aerosolization chamber having one or more air inlets on a first side of the aerosolization chamber for providing air flow across the heater coil in a direction perpendicular to a longitudinal axis of the tube, the aerosolization chamber having a duct providing an air outlet, the duct on a second side of the aerosolization chamber opposite from the first side, the duct extending in a direction parallel to the longitudinal axis of the tube.

13. The device of claim 12 further including a battery having a first electrode electrically connected to a first end of the heater coil and a second electrode electrically connected to the tube.

14. The device of claim 12 further comprising an electronic controller electrically connected to a battery, to the pump, to the heater coil, and to a sensor adapted for sensing inhalation at the air outlet, with the electronic controller activating the pump and the heater coil upon sensing inhalation.

15. The device of claim 12 wherein the tube is round, the tube outlets extend radially outward through the sidewall of the tube, and the heater coil is concentric with the tube.

16. The device of claim 12 wherein the duct is offset from a central longitudinal axis of the device.

* * * * *